US006130410A

United States Patent [19]

Kita

[11] Patent Number: 6,130,410

[45] Date of Patent: Oct. 10, 2000

[54] CERAMIC HEATER AND PROCESS FOR PRODUCING THE SAME

[75] Inventor: Hideki Kita, Kanagawa-ken, Japan

[73] Assignee: Isuzu Ceramics Research Institute Co., Ltd, Kanagawa-ken, Japan

[21] Appl. No.: 08/985,525

[22] Filed: Dec. 5, 1997

[30] Foreign Application Priority Data

Dec. 11, 1996 [JP] Japan ..... 8-346464

[51] Int. Cl.[7] ..... F23Q 7/22

[52] U.S. Cl. ..... 219/270; 219/544; 123/145 A

[58] Field of Search ..... 219/270, 544, 219/552, 553, 541; 123/145 A, 145 R; 361/266; 501/95.3, 93; 428/446

[56] References Cited

U.S. PATENT DOCUMENTS

| | | | |
|---|---|---|---|
| 4,119,832 | 10/1978 | Audesse et al. | 219/270 |
| 4,337,498 | 6/1982 | Takahasi et al. | 361/266 |
| 4,556,780 | 12/1985 | Atsumi et al. | 219/270 |
| 4,639,712 | 1/1987 | Kobayashi et al. | 338/238 |
| 4,742,209 | 5/1988 | Minegishi et al. | 219/270 |
| 4,786,781 | 11/1988 | Nozaki et al. | 219/270 |
| 4,923,829 | 5/1990 | Yasutomi et al. | 501/95.3 |
| 5,030,597 | 7/1991 | Ogata et al. | 501/93 |
| 5,059,768 | 10/1991 | Hatanaka et al. | 219/270 |
| 5,084,606 | 1/1992 | Bailey et al. | 219/270 |
| 5,086,210 | 2/1992 | Nunogaki et al. | 219/270 |
| 5,143,275 | 9/1992 | Hara et al. | 228/119 |
| 5,206,484 | 4/1993 | Issartel | 219/270 |
| 5,218,183 | 6/1993 | Kimata | 219/270 |
| 5,264,681 | 11/1993 | Nozaki et al. | 219/544 |
| 5,304,778 | 4/1994 | Dasgupta et al. | 219/270 |
| 5,756,215 | 5/1998 | Sawamura et al. | 428/446 |
| 5,811,761 | 9/1998 | Kita et al. | 219/270 |
| 5,850,072 | 12/1998 | Eckert | 219/523 |
| 5,880,433 | 3/1999 | Eller et al. | 219/270 |

FOREIGN PATENT DOCUMENTS

| | | |
|---|---|---|
| 0650020 | 4/1995 | European Pat. Off. . |
| 0771773 | 5/1997 | European Pat. Off. . |
| 60-019404 | 5/1985 | Japan . |
| 6-272861 | 9/1994 | Japan . |
| 9118245 | 11/1991 | WIPO . |

*Primary Examiner*—Teresa Walberg
*Assistant Examiner*—Quang Van
*Attorney, Agent, or Firm*—Browdy And Neimark

[57] ABSTRACT

This ceramic heater is increased in bulk density and decreased in production cost by using an unsintered composite as an unsintered filling member filled in a protective pipe without application thereto of a filling pressure while preventing a heating element from deteriorating. In this ceramic heater, the heating element capable of heating by flowing electricity therethrough is disposed in the protective pipe, which is filled with the unsintered composite. In the unsintered composite, inorganic compound particles are disposed between insulating ceramic particles. In this ceramic heater, the heating element is fixed to the inner wall surface of the protective pipe with a heat-resistant glass layer. The heat-resistant glass layer is partially penetrated into the unsintered composite. The open end portion of the protective pipe is hermetically sealed with a heat-resistant sealing member while allowing extension of lead wires from the end portion of the protective pipe.

23 Claims, 4 Drawing Sheets

CERAMIC HEATER AND PROCESS FOR PRODUCING THE SAME

BACKGROUND OF THE INVENTION

1. Field of the Invention

The present invention relates to a ceramic heater applicable to a glow plug for use in a diesel engine or the like, and a process for producing the same.

2. Description of the Prior Art

As conventional glow plugs, there are known ceramic heaters produced by a method wherein a heating element made of a high-melting metal such as tungsten or molybdenum is sandwiched between silicon nitride moldings, which are then hot-pressed to fire the silicon nitride portions while simultaneously integrating the silicon nitride portions with the heating section (see, for example, Japanese Patent Laid-Open No. 272,861/1994 and Japanese Patent Publication No. 19,404/1985).

The ceramic heater as disclosed in the Japanese Patent Laid-Open No. 272,861/1994, which has a heating resistor made of an inorganic conductive material and embedded in a silicon nitride sinter, is produced by producing a silicon nitride molding, disposing a coiled heating resistor made of a tungsten wire and heating resistors made of tungsten wires constituting lead wires connected to the above-mentioned heating resistor onto the silicon nitride molding, superposing thereon other silicon nitride moldings in such a way as to sandwich the heating resistors therebetween, and pressing and firing them to form a silicon nitride sinter.

It is known that a high-melting metal such as tungsten or molybdenum for forming a heater coil becomes recrystallized and brittle at a temperature of 1,100° C or above. When a material filled in a protective pipe is sintered at a temperature as high as 1,400 to 1,900° C. to form a ceramic heater according to the customary method, the heater coil disposed in the protective pipe becomes brittle, and this is a primary cause of disconnection of the heater coil. Furthermore, in order to sinter a slurry, an expensive sintering furnace is required while involving a complicated process. This is a primary factor of increasing the cost of the ceramic heater.

SUMMARY OF THE INVENTION

An object of the present invention, which is aimed at solving the foregoing problems, is to provide an inexpensively producible ceramic heater which is produced by disposing a heating element capable of heating by flowing electricity therethrough in a protective pipe, filling a composite of ceramic particles and an inorganic compound converted at about 600° C. in the protective pipe to attain a high density in the protective pipe, and sealing the end portion of the protective pipe without sintering thereof for preventing deterioration of the heating element otherwise attributable to firing; and a process for producing the same.

The present invention is directed to a ceramic heater comprising a protective pipe provided with a heating section constituted of a dense ceramic and having one end closed and the other end open; a heating element having the capability of heating by flowing electricity therethrough, disposed in the protective pipe and connected to lead wires; an unsintered composite constituted of insulating ceramic particles filled in the protective pipe and inorganic compound particles disposed between the above-mentioned particles; and a heat-resistant sealing member hermetically sealing the open end portion of the protective pipe while allowing extension of the lead wires out of the end portion of the protective pipe.

This ceramic heater may further have a heat-resistant glass layer, part of which penetrates into the unsintered composite while fixing the heating element to the inner wall surface of the protective pipe.

The ceramic particles may be chosen at a small-size particle to large-size particle average particle size ratio of 1/10 to 1/2. The ceramic particles may also be a material having a thermal expansion coefficient not exceeding $6\times10^{-6}$/° C. Further, the ceramic particles may be a powder of silicon nitride, silicon carbide, mullite or a mixture thereof.

On the other hand, the inorganic compound particles may be formed by heating an organosilicon polymer or alkoxide to or above a predetermined temperature by means of the heating element or the like for conversion thereof. The inorganic compound particles may also be converted particles having an average particle size not exceeding 1.5 microns.

The bulk density of the unsintered composite may be at least 55%. Further, the unsintered composite may comprise Si and at least one element of C, O and N.

On the other hand, the ceramic constituting the protective pipe may be silicon nitride, silicon carbide, sialon or a composite material thereof.

The heating element may be made of tungsten, a tungsten alloy, molybdenum disilicide, titanium nitride, a composite material of titanium nitride, iron, or a nickel alloy. The end portions of the lead wires connected to the heating element are inserted and fixed into one end portion of a metal tube fixed to the protective pipe, while other lead wires are inserted and fixed into the other end portion of the metal tube. On the other hand, the heating element may be a coiled heating wire made of tungsten or a tungsten alloy, while the lead wires connected to the heating wire may be made of tungsten or a tungsten alloy. The lead wires connected to the tungsten wires via the metal tube and extending out of the protective pipe may be nickel wires.

Further, the metal tube may be made of a Fe—Ni—Co alloy, for example KOVAR while the lead wires inserted into the metal tube may be joined to each other with a brazing filler metal. This is because the Fe—Ni—Co alloy that may be used to fabricate the metal tube is substantially the same in thermal expansion coefficient as the tungsten constituting the heating element and the lead wires and the $Si_3N_4$ constituting the protective pipe and the closing plug, thus developing little gaps and cracks, otherwise attributable to a difference in thermal expansion coefficient, among the protective pipe, the metal tube and the closing plug even during application thereto of heating cycles.

Further, the lead wires extending from the protective pipe may be constituted of a pair of nickel wires.

On the other hand, the heat-resistant sealing member hermetically sealing the end portion of the protective pipe may be constituted of a sealing plug made of a material having a thermal expansion coefficient equal or close to that of the protective pipe, and a heat-resistant member made of a glass or a resin filled in the gaps between the protective pipe and the sealing plug except for the metal tube. Meanwhile, the glass constituting the heat-resistant member may contain silicon and boron.

On the other hand, the heat-resistant glass layer may be made of a dehydration/condensation type glass containing Si, Cr, Fe and O.

This ceramic heater may be applied to a glow plug for use in a diesel engine. In this case, one of the lead wires extending from the protective pipe is connected to a metal ring supporting the protective pipe around an outer cylinder, while the other lead wire is connected to an electrode supported in an insulated state around the outer cylinder, whereby the ceramic heater can be incorporated into the glow plug.

The present invention is also directed to a process for producing a ceramic heater, comprising the step of joining lead wires to a heating element made of a metal or conductive ceramic capable of heating by flowing electricity therethrough; the step of attaching ceramic particles to the heating element; the step of immersing the heating element having the ceramic particles attached thereto in a solution containing an organosilicon polymer or alkoxide component capable of being converted into an inorganic compound at a temperature of 600° C. or above to infiltrate the solution into between the ceramic particles; the step of coating the surface of the resultant product with a dehydration/condensation type glass; the step of subsequently inserting the coated product into a protective pipe having one end closed and the other end open; the step of sealing the open end portion of the protective pipe with a heat-resistant glass or a heat-resistant resin; and the step of heating the heating element by flowing electricity therethrough to convert the solution infiltrated in between the ceramic particles into an inorganic compound.

As described above, in this ceramic heater, a ceramic powder, i.e., the ceramic particles, after being attached to the heating element such as a heater coil made of a tungsten wire by the slip casting method, is impregnated with the solution of an organosilicon polymer or the like to attain a high degree of densification, has the surface thereof coated with a dehydration/condensation type glass, inserted into the protective pipe, an end portion of which is then sealed with a heat-resistant sealing member, followed by flowing electricity through the heating element for heating thereof, whereby the resulting heat is made the most of to convert the solution infiltrated in between the ceramic particles into the inorganic compound for formation of an unsintered composite. Accordingly, this ceramic heater becomes an inexpensive stable product since high-temperature sintering is not required in the production process to enable the heating element to be prevented from deteriorating.

A glow plug comprising a protective pipe made of a heat-resistant metal is usually swaged to attain a high degree of internal densification after the protective pipe is filled with a filler, while a glow plug comprising a protective ceramic pipe incapable of plastic deformation involves an incapability of densification of a filler by swaging. By contrast, in the ceramic heater of the present invention, a high degree of densification can be attained even without pressing since the ceramic particles as the filler are impregnated with the solution of an organosilicon polymer or the like, followed by solidification thereof.

In this ceramic heater, since the filling member filled in the protective pipe is not sintered at a temperature as high as 1,700° C. and is constituted of an unsintered composite containing a precursor such as an organosilicon polymer or the like as described above, the heating element made of a tungsten wire or the like is not exposed to such a high temperature without deterioration thereof and the precursor can be increased in bulk density through conversion into inorganic compound particles when heated at about 600° C. while using the protective pipe made of even a ceramic incapable of being subjected to a filling pressure, whereby the life span of the heating element can be greatly prolonged without disconnection of the heating element even when it undergoes repeated thermal stresses. Further, it can be inexpensively produced since no sintering step is required. Further, since the lead wires inside and outside the protective pipe are connected to each other using the metal tube made of Kovar having a good wettability with silicon nitride in the end portion of the protective pipe for the purpose of drawing out the lead wires while sealing the gaps with a glass, the heating element and the filling member in the protective pipe are not exposed to oxygen, whereby they can be prevented from deteriorating.

DETAILED DESCRIPTION OF THE EMBODIMENTS

Figure 1:
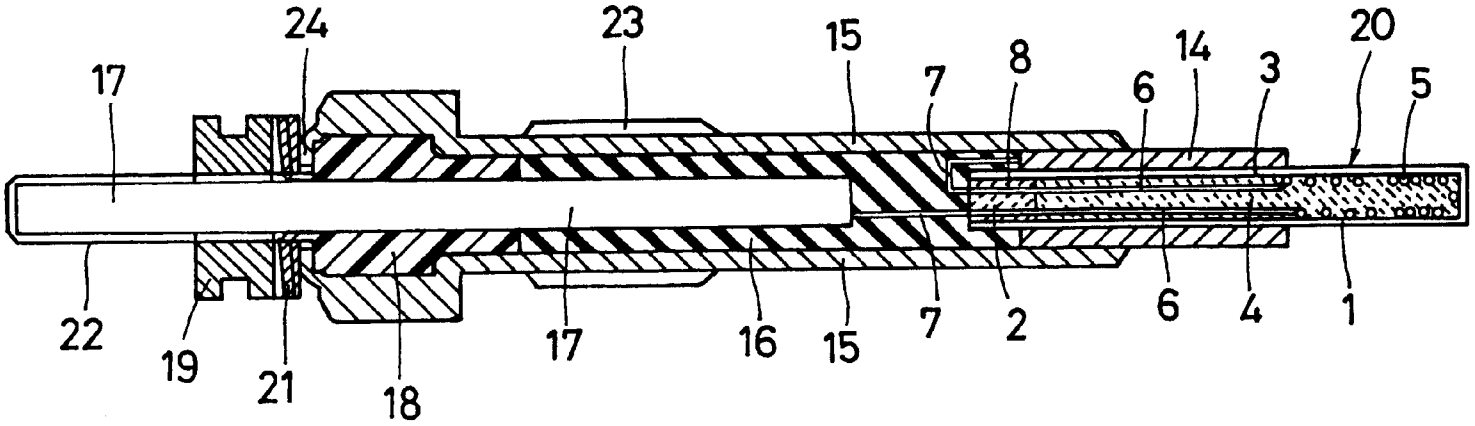
FIG. 1 is a cross-sectional view of a glow plug into which one example of the ceramic heater of the present invention is incorporated.

Now a following description will be made of an example of a ceramic heater and a process for producing the same according to the present invention while referring to the accompanying drawings.

This ceramic heater is preferably applicable to a glow plug for use in a diesel engine. The glow plug has the ceramic heater incorporated thereinto and provided with a heating section 20 capable of heating by flowing electricity therethrough. The glow plug is mainly constituted of a hollow protective pipe 1 formed from a ceramic; an iron ring 14 having the protective pipe inserted thereinto; an outer cylinder 15 having part of the iron ring 14 fitted therein for fixation thereof; a metal electrode 17 inserted in an insulated state into the outer cylinder 15 in such a way as to have part thereof protrude from the outer cylinder 15; a filling member 16 made of an insulating silicone rubber and filled between the metal electrode 17 and the protective pipe 1 as well as on the outer sides thereof in the outer cylinder 15; a filling member 18 made of an insulating epoxy resin, filled in the large-diameter bore of the outer cylinder 15 between the outer cylinder 15 and the metal electrode 17 positioned at an end portion thereof, and fixed with a caulking 24 at an end portion of the outer cylinder 15; and a nut 19 screwed into a screw 22 provided in the metal electrode 17 via an insulating member 21 for fixation of the metal electrode 17 to the outer cylinder 15. A screw 23 is formed around the outer periphery of the outer cylinder 15 for fixation of the glow plug to a heater coil of other part such as an engine body.

Further, the metal electrode 17 of the glow plug having this ceramic heater incorporated thereinto is connected to a power source by means of a lead wire or the like, while the metal electrode 17 inserted into the outer cylinder 15 is connected to a lead wire 7 embedded in the filling member 16 made of the silicone rubber. On the other hand, the other lead wire 7 is connected to an iron ring 14 for grounding. Accordingly, an electric current from the power source is flowed from the metal electrode 17 via the lead wire 7 through the heating element 5 provided in the heating section 20, while the heating element 5 is grounded with the iron ring 14 via the lead wire 7.

This ceramic heater in the foregoing constitution is characterized particularly by the structure of the heating section 20 to be heated by flowing electricity therethrough. The heating section 20 can particularly be produced without sintering the filling member filled or inserted in the protective pipe 1 in a state of an unsintered composite as it is. Thus, the heating section 20 can be inexpensively produced while preventing the heating element 5 and the lead wires 6, 7 from deteriorating. This ceramic heater is mainly constituted of the protective pipe 1 made of a dense ceramic and having one end closed and the other end open; the heating element 5 having a capability of heating by flowing electricity therethrough, disposed in the protective pipe 1 and connected to the lead wires 6, 7; the unsintered composite 4 filled in the protective pipe 1; a heat-resistant glass layer 3 used to fix the heating element 5 to the inner wall surface of the protective pipe 1; and heat-resistant sealing members (i.e., a closing plug 2 and a glass 10) hermetically sealing the open end portion of the protective pipe 1 while allowing extension of the lead wires 7 from the end portion of the protective pipe 1.

Figure 4:
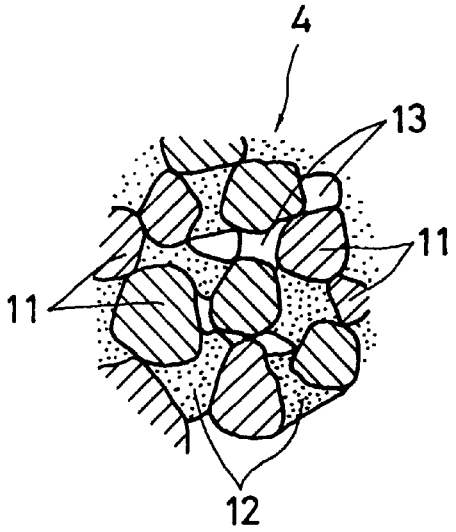
FIG. 4 is an illustration showing the texture of the unsintered composite of the ceramic heater of FIG. 1.

Meanwhile, as shown in FIG. 4, the unsintered composite 4 is constituted of insulating ceramic particles 11 and an inorganic compound (inorganic compound particles) 12 disposed between the particles 11 while leaving voids 13 among the particles 11. On the other hand, the heat-resistant layer 3 is partly penetrated into the unsintered composite 4 to be in a state of being joined therewith. The lead wires 7 extending from the protective pipe 1 are a pair of nickel wires, one of which is connected to the electrode 17 supported in an insulated state by the outer cylinder 15, and the other one of which is connected to the metal ring 14 for supporting the protective pipe 1 around the outer cylinder 15.

The ceramic particles 11 constituting the unsintered composite 4 are made up of a powder of small-size particles of about 8 microns in average particle size and a powder of large-size particles of about 40 microns in average particle size. The ceramic particles 11, which may be a material having a thermal expansion coefficient not exceeding $6\times10^{-6}$/° C., are made especially of silicon nitride ($Si_3N_4$), silicon carbide (SiC), mullite ($Al_6Si_2O_{13}$), or a mixed powder thereof. In this example, the unsintered composite 4 is constituted of Si and at least one element of C, O and N, and naturally further contains Al in the case where mullite is used. On the other hand, the inorganic compound particles 12 constituting the unsintered composite 4 are formed through conversion when a precursor such as an organosilicon polymer or alkoxide is heated by the heating element 5 to a temperature of 600° C. or above. Further, the bulk density of the unsintered composite 4 is at least 55%. Further, the inorganic compound particles 12 are converted particles having an average particle size not exceeding 1.5 microns.

The ceramic constituting the protective pipe 1 is silicon nitride, silicon carbide, sialon (Si—Al—O—N), or a composite material thereof. On the other hand, the heating element 5 is made of tungsten, a tungsten alloy, molybdenum disilicide, titanium nitride, a composite material of titanium nitride, iron, or a nickel alloy.

In this example, the heating element 5 is constituted of a coiled tungsten wire. The end portions of the lead wires 6 connected to the heating element 5 are inserted and fixed into one end portion of the metal tube 8 fixed to the protective pipe 1. The lead wires 6 are made of tungsten wires made of tungsten or a tungsten alloy, i.e., heating wires. On the other hand, the lead wires 7 are inserted and fixed into the other end portion of the metal tube 8. The lead wires 7 are made of nickel wires extending from the end portion of the protective pipe and embedded in the filling member 16. The nickel wires constituting the lead wires 7 perform the function of autogenous current control in the ceramic heater since they are increased in electric resistance when heated up to a high temperature. On the other hand, the metal tube 8 is made of a Fe—Ni—Co alloy. The lead wires 6, 7 are inserted into the metal tube 8, and joined to each other with a brazing filler metal material 9 such as a silver brazing filler.

The heat-resistant sealing member hermetically sealing the end portion of the protective pipe 1 is constituted of the closing plug 2 of a resin or the like material having a thermal expansion coefficient equal or close to the thermal expansion coefficient of the protective pipe 1, and a heat-resistant member 10 made of a glass or a resin filled in the clearances between the protective pipe 1 and the closing plug 2 except for the metal tube 8. The glass constituting the heat-resistant member 10, which contains silicon Si and boron B, is a material having such a good wettability with an $Si_3N_4$ ceramic that it can well join the metal tube 8 to between the protective pipe 1 and the closing plug 2 to well hermetically seal the gaps formed therebetween.

On the other hand, in order to fix the heating element 5 to the inner wall surface of the protective pipe 1, the heat-resistant glass layer 3 fixed on the inner wall surface of the protective pipe 1 is made of a dehydration/condensation type glass containing Si, Cr, Fe and O. Accordingly, the heat-resistant glass layer 3, which is positioned in a boundary portion between the protective pipe 1 and the unsintered composite 4 of the filling member therein, absorbs a stress applied to the protective pipe 1 to prevent breakage of the protective pipe 1 made of a ceramic, the heating element 5 and the lead wires 6 while preventing formation of gaps in the boundary portion between the protective pipe 1 and the unsintered composite 4 to thereby perform the function of well fixing the heating element 5 and the lead wires 6 to the protective pipe 1, when a precursor such as an organosilicon polymer or the like filled in the unsintered composite 4 is converted into inorganic compound particles 12.

Now a description will be made of a process for producing a ceramic heater according to the present invention. This process for producing a ceramic heater mainly comprises the step of joining lead wires 6 to a heating element 5 made of a metal or a conductive ceramic and having a capability of heating by flowing electricity therethrough, the step of attaching ceramic particles 11 to the heating element 5, the step of immersing the heating element 5 in a solution containing an organosilicon polymer or alkoxide component capable of being converted into an inorganic compound (particles) 12 at a temperature of 600° C. or above to infiltrate the solution into between the ceramic particles 11, the step of coating the surface of the resultant product with a dehydration/condensation type glass 3, the step of subsequently inserting the resultant product into a protective pipe 1 made of a dense ceramic and having one end closed and the other end open, the step of sealing the open end portion of the protective pipe with a heat-resistant glass 10 and a closing plug made of a heat-resistant resin, and the step of subsequently flowing electricity through the heating element 5 to convert the solution infiltrated in between the ceramic particles 11 into an inorganic compound 12.

EXAMPLE 1

A first example of the process of the present invention for producing a ceramic heater will now be described. A tungsten wire having a wire diameter of 0.2 mm, a resistance of 0.4 Ω and a coil diameter of 3.4 mm was used as one constituting a coiled heating element 5 and straight lead wires 6. A Kovar tube having a bore of 0.6 mm in inner diameter and a length of 8 mm was used as a metal tube 8. Nickel wires having a wire diameter of 0.5 mm were used as lead wires 7. A silver brazing filler paste was injected into the bore of the Kovar tube 8. The end portions of the lead wires 6 were inserted into one end portion of the bore, while the lead wires 7 were inserted into the other end portion of the bore. The Kovar tube 8 was caulked to fix the lead wires 6, 7 to the Kovar tube 8. Subsequently, the resultant product was heated in vacuo at 750° C. to fuse the silver brazing filler 9, which was then solidified to firmly join the tungsten lead wires 6 to the nickel lead wires 7 with a very low contact resistance. Since a Fe—Ni—Co alloy is substantially the same in thermal expansion coefficient as tungsten and $Si_3N_4$, formation of gaps and cracks, attributable to a difference in thermal expansion coefficient, can be prevented among the protective pipe 1, the metal tube 8 and the closing plug 2 even during application thereto of heating cycles.

The product comprising the lead wires 7, the lead wires 6 and the heating element 5 fixed to each other with the metal tube 8 and the silver brazing filler 9 was set in a gypsum mold having a hole of 3.5 mm in inner diameter and 40 mm in depth. A slurry containing a silicon nitride ($Si_3N_4$) powder of 8 microns in average particle size was injected into the remaining cavity to be solidified by water absorption, whereby the $Si_3N_4$ powder was attached to the lead wires 6, the heating element 5 and the metal tube 8 to make a bar-like form having a total length of 35 mm and a diameter of 3.5 mm. The molding was dried, and then immersed in a solution of polycarbosilane (PCS) as an organosilicon polymer in toluene. In this case, the solution of the organosilicon polymer was penetrated into among particles due to capillarity. The molding was taken out of the solution after the lapse of a predetermined time, and then dried. The foregoing procedure of immersing the molding in the solution and drying it was repeated twice. Table 1 shows changes in the relative density (%) of the molding with the frequency of treatment wherein use was made of each of solutions of the organosilicon polymer having different concentrations (wt. %). As is understandable from Table 1, immersion thrice of the molding in the solution of the organosilicon polymer increased the relative density thereof by about 30% as against immersion twice, irrespective of the concentration of the solution.

TABLE 1

| Relative density of molding impregnated with organosilicon polymer | | |
|---|---|---|
| Concn. of soln. (wt. %) | Frequency of treatment (No.) | Rel. density of molding (%) |
| 10 | 0 | 54 |
| | 1 | 62 |
| | 2 | 69 |
| 15 | 0 | 54 |
| | 1 | 64 |
| | 2 | 72 |
| 18 | 0 | 54 |
| | 1 | 65 |
| | 2 | 68 |

Figure 2:
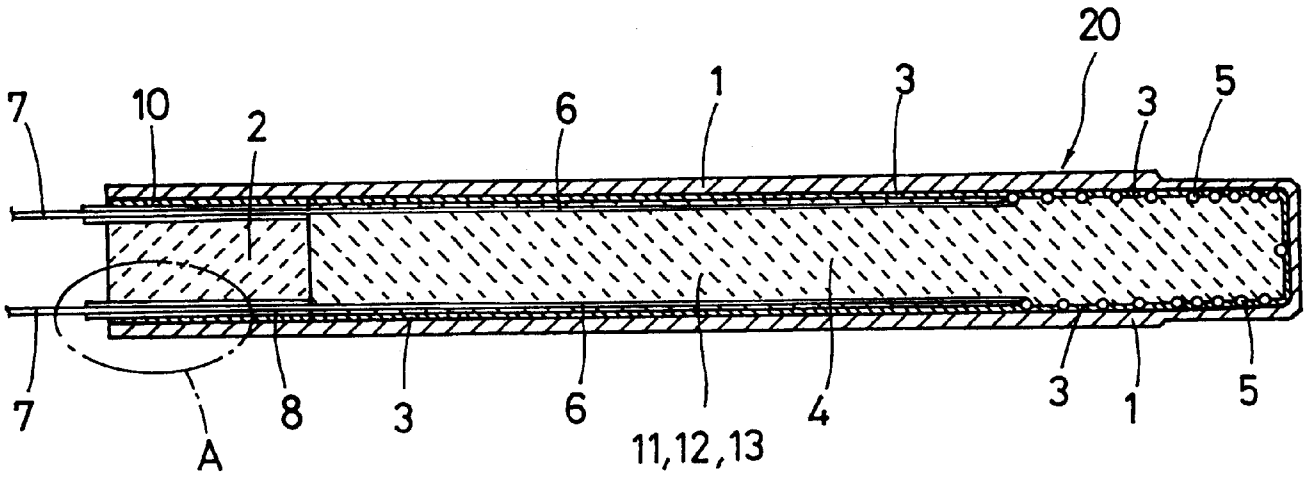
FIG. 2 is an enlarged partial cross-sectional view of the ceramic heater of FIG. 1.
Figure 3:
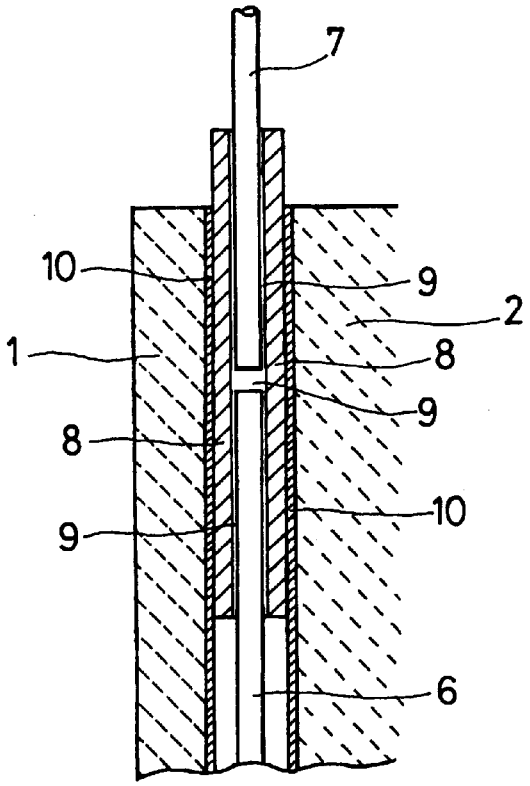
FIG. 3 is an enlarged cross-sectional view of a portion denoted by A in FIG. 2.

The surface of the molding was coated with a pasty dehydration/condensation glass containing Fe, Cr, O and Si, and the molding, before being dried, was inserted into a silicon nitride sheath of 4 mm in outer diameter and 3.6 mm in inner diameter, i.e., a protective pipe 1. After the molding inserted into the protective pipe 1 was dried, a silicon nitride closing plug 2 was fitted into the open end portion of the protective pipe 1, and clearances formed among the protective pipe 1, the closing plug 2 and the molding were filled with a glass paste containing Si and B to hermetically seal them. The resultant product was degreased, then heated in a nitrogen atmosphere to a predetermined temperature to fuse the glass paste, cooled in a furnace, and then taken out of the furnace to obtain a ceramic heater as a heating section 20 as shown in FIG. 2.

Figure 5:
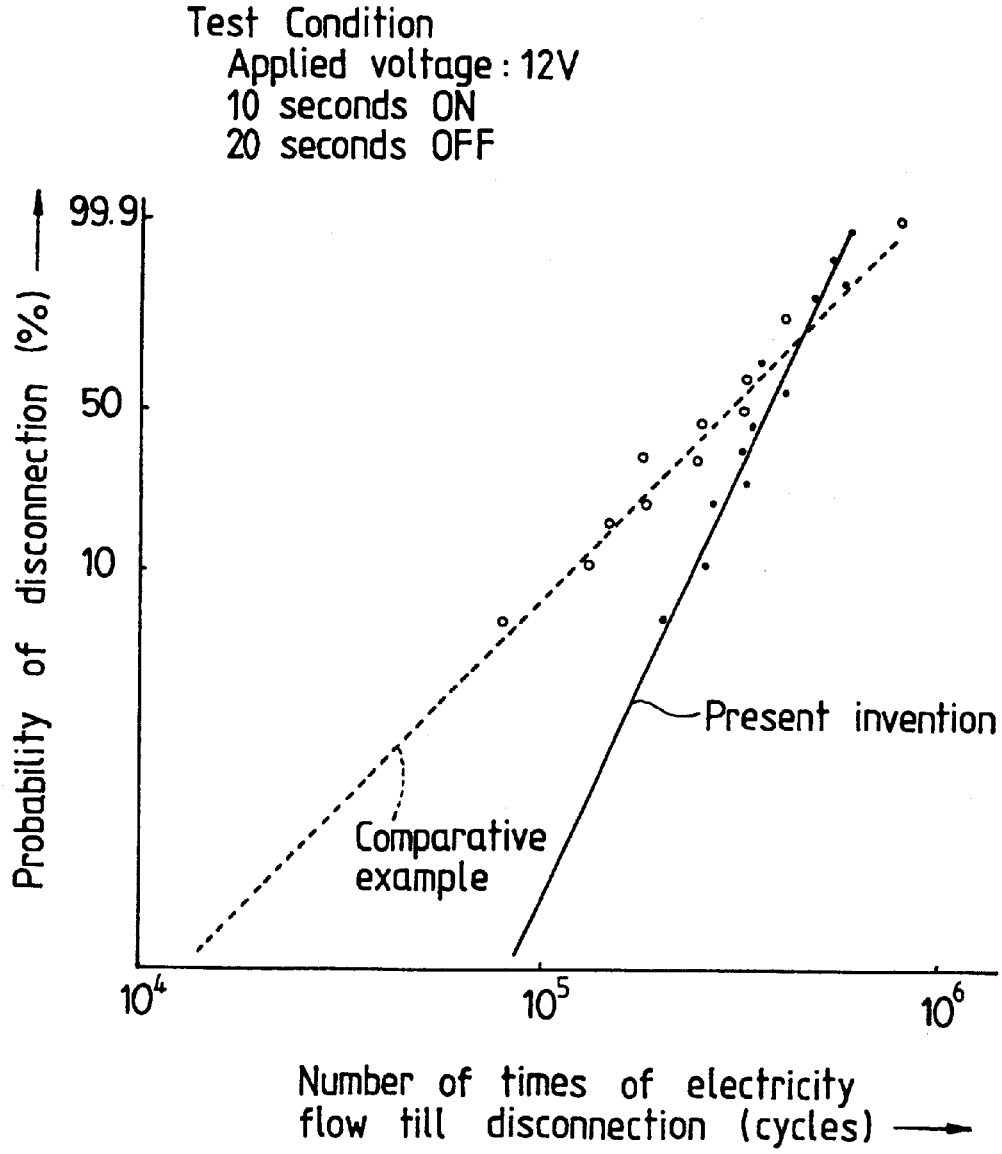
FIG. 5 is a graph showing the results of durability tests of ceramic heaters.

Subsequently, the ceramic heater thus produced was incorporated to fabricate a glow plug provided with the ceramic heater according to the present invention (hereinafter referred to as "of the present invention"). For comparison, a heater was produced by the conventional hot-pressing method, and the heater was incorporated to fabricate a conventional glow plug (hereinafter referred to as "of Comparative Example) in the same manner. Then, electricity flow through each of the glow plugs of the present invention and Comparative Example was repeated to find the frequency thereof till disconnection. Data was summarized by Weibull plotting to obtain the results as shown in FIG. 5. As for the conditions of the electricity flow test for each glow plug, the applied voltage was 12 V, and each cycle involved 10 seconds of electricity flow (on) and 30 seconds of stop (off). As is apparently understandable from FIG. 5, the glow plug of the present invention is overwhelmingly low in the probability of disconnection in terms of the frequency of electricity flow till disconnection (i.e., cycles) as compared with the glow plug of Comparative Example.

It was further confirmed by X-ray diffractometry and with an electron microscope that, when electricity was flowed through the glow plug of the present invention, the tip portion of the ceramic heater was heated up to 1,200° C., and, as a result, the solution of the organosilicon polymer infiltrated in between the ceramic particles 11 constituting the aforementioned molding was converted into fine crystal particles of at most 1 micron in average particle size containing Si, O, C and N elements, i.e., inorganic compound particles 12. In this case, some voids 13 existed between the ceramic particles 11 and the inorganic compound particles 12 as shown in FIG. 4. When the tungsten wires, i.e., the lead wires 6 and the coiled heating element 5 were taken out of the ceramic heater after completion of $5\times10^4$ cycles of electricity flow through the glow plug of the present invention to examine the state thereof, it was further found out that the tungsten wires had a sufficient flexibility comparable to the state thereof before the test except for the tip portion of the heating element 5 heated to a high temperature. By contrast, since the conventional heater was heated and sintered at a high temperature, i.e., 1,700° C., in the course of production thereof, grain growth occurred in tungsten wires, which was therefore broken even by a very little impact.

EXAMPLE 2

A second example of the ceramic heater of the present invention will now be described. A product comprising lead wires 7, lead wires 6 and a heating element 5 fixed with a metal tube 8 and a silver brazing filler 9 in the same manner as in Example 1 was set in a gypsum mold in the same manner as described above. The remaining cavity was filled with a mixed powder of a mullite ($Al_6Si_2O_{13}$) powder of 5 microns in average particle size and a silicon nitride powder of 45 microns in average particle size. The packing density was improved to 70% by using the large-size and small-size different powders in combination as the mixed powder. The packing density was further improved to 80% by impregnating the mixed powder with an organosilicon polymer. The resulting molding was used to fabricate a ceramic heater in the same manner as in Example 1. When the same test as in Example 1 was carried out, the same good results as in Example 1 could be obtained in respect of the performance and durability of the ceramic heater.

EXAMPLE 3

A third example of the ceramic heater of the present invention will now be described. In Example 3, substantially the same steps (process) as in Example 1 were repeated to produce a ceramic heater except that lead wires and heating element made of an Fe—Cr—Al alloy to be disposed inside a protective pipe 1 was used instead of the lead wires 6 and heating element 5 made of tungsten used in Example 1. When the same performance and durability test as in Example 1 was carried out using this ceramic heater, the same good results as in Example 1 could be obtained in respect of the performance and durability of the ceramic heater.

What is claimed is:

1. A ceramic heater comprising a protective pipe constituted of a dense ceramic and having one end closed and the other end open; a heating element having the capability of heating by flowing electricity therethrough, disposed in said protective pipe and connected to lead wires; an unsintered composite constituted of a mixture of ceramic particles and inorganic compound particles filled in said protective pipe such that said inorganic compound particles and said ceramic particles are mixed together; and a heat-resistant sealing member hermetically sealing an open end portion of said protective pipe while allowing extension of said lead wires out of an end portion of said protective pipe.

2. A ceramic heater as claimed in claim 1, which has a heat-resistant glass layer, part of which penetrates into said unsintered composite while fixing said heating element to an inner wall surface of said protective pipe.

3. A ceramic heater as claimed in claim 1, wherein said ceramic particles include small-size particles and large-size particles in an average particle size ratio of the small-size particles to the large-size particles of 1/10 to 1/2.

4. A ceramic heater as claimed in claim 1, wherein said ceramic particles include a material having a thermal expansion coefficient not exceeding $6\times10^{-6}$/° C.

5. A ceramic heater as claimed in claim 1, wherein said ceramic particles include a powder of silicon nitride, silicon carbide, mullite or a mixture thereof.

6. A ceramic heater as claimed in claim 1, wherein said inorganic compound particles are formed by heating an organosilicon polymer or alkoxide to or above a predetermined temperature for conversion thereof.

7. A ceramic heater as claimed in claim 1, wherein said inorganic compound particles are converted particles having an average particle size not exceeding 1.5 microns.

8. A ceramic heater as claimed in claim 1, wherein the bulk density of said unsintered composite is at least 55%.

9. A ceramic heater as claimed in claim 1, wherein said unsintered composite comprises Si and at least one element of C, O and N.

10. A ceramic heater as claimed in claim 1, wherein said ceramic constituting said protective pipe is silicon nitride, silicon carbide, sialon or a composite material thereof.

11. A ceramic heater as claimed in claim 1, wherein said heating element is made of tungsten, a tungsten alloy, molybdenum disilicide, titanium nitride, a composite material of titanium nitride, iron, or a nickel alloy.

12. A ceramic heater as claimed in claim 1, wherein said lead wires each comprise a metal tube fixed to said protective pipe, a first lead wire inserted and fixed into one end portion of said metal tube and connected to said heating element, and a second lead wire inserted and fixed into the other end portion of said metal so as to extend out of said protective pipe.

13. A ceramic heater as claimed in claim 12, wherein said heating element is a coiled heating wire made of any one of tungsten and a tungsten alloy, said first lead wire is made of any one of tungsten and a tungsten alloy, and said second lead wire is made of a nickel wire.

14. A ceramic heater as claimed in claim 12, wherein said metal tube is made of Fe—Ni—Co alloy, while said lead wires inserted into said metal tube are joined to each other with a brazing filler metal.

15. A ceramic heater as claimed in claim 1, wherein said lead wires extending from said protective pipe are constituted of a pair of nickel wires.

16. A ceramic heater as claimed in claim 1, wherein said heat-resistant sealing member hermetically sealing the end portion of said protective pipe is constituted of a sealing plug made of a material having a thermal expansion coefficient equal or close to that of said protective pipe, and a heat-resistant member made of a glass or a resin filled in the clearances between said protective pipe and said sealing plug except for a metal tube.

17. A ceramic heater as claimed in claim 16, wherein said glass constituting said heat-resistant member contains silicon and boron.

18. A ceramic heater as claimed in claim 1, wherein said heat-resistant sealing member is made of a dehydration or condensation type glass containing Si, Cr, Fe and O.

19. A ceramic heater as claimed in claim 1, wherein one of said lead wires extending from said protective pipe is connected to a metal ring supporting said protective pipe around an outer cylinder, while the other lead wire is connected to an electrode supported in an insulated state around said outer cylinder, when the ceramic heater is applied to a glow plug for use in a diesel engine.

20. A process for producing a ceramic heater, comprising the step of joining lead wires to a heating element made of a metal or conductive ceramic capable of heating by flowing electricity therethrough; the step of attaching ceramic particles to said heating element; the step of immersing said heating element having said ceramic particles attached thereto in a solution containing an organosilicon polymer or alkoxide component capable of being converted into an inorganic compound at a temperature of 600° C. or above to infiltrate said solution into between said ceramic particles; the step of coating the surface of a resultant product with a dehydration or condensation type glass; the step of subsequently inserting a coated product into a protective pipe having one end closed and the other end open; the step of sealing the open end portion of said protective pipe with a heat-resistant glass or a heat-resistant resin; and the step of heating said heating element by flowing electricity therethrough to convert said solution infiltrated in between said ceramic particles into an inorganic compound.

21. A ceramic heater as claimed in claim 6, wherein the inorganic compound is formed at approximately 600° C.

22. A ceramic heater as claimed in claim 2, wherein the heat-resistant glass fixing the heating element (5) to the inner wall surface comprises a dehydration or condensation glass.

23. A ceramic heater as claimed in claim 22, wherein the dehydration and condensation glass includes silicon, chromium, iron, and oxygen.

* * * * *